US005617664A

United States Patent [19]

Troncoso

[11] Patent Number: 5,617,664

[45] Date of Patent: Apr. 8, 1997

[54] RECOIL ABSORBING STABILIZER FOR A WEAPON

[76] Inventor: Vincent F. Troncoso, 14090-6100 Rd., Montrose, Colo. 81401

[21] Appl. No.: 517,428

[22] Filed: Aug. 21, 1995

[51] Int. Cl.[6] ..... F41B 5/20

[52] U.S. Cl. ..... 42/1.06; 124/89

[58] Field of Search ..... 42/1.06, 97; 89/198; 124/89; 482/46, 121, 128

[56] References Cited

U.S. PATENT DOCUMENTS

| | | | |
|---|---|---|---|
| 3,132,861 | 5/1964 | Horney | 482/128 |
| 3,290,815 | 12/1966 | Edwards | 41/1.06 |
| 4,591,151 | 5/1986 | Hensley | 482/127 |
| 4,982,719 | 1/1991 | Haggard et al. | 124/89 |
| 5,343,649 | 9/1994 | Petrovich | 42/1.06 |
| 5,370,104 | 12/1994 | Neie | 124/89 |

*Primary Examiner*—Michael J. Carone
*Assistant Examiner*—Christopher K. Montgomery
*Attorney, Agent, or Firm*—Donald E. Nist

[57] ABSTRACT

The improved stabilizer has a hollow elongated preferably cylindrical housing with a central space extending the length thereof to open opposite ends. An end cap closes one end of the housing and bears a connector for attachment of the housing to a weapon. The opposite end of the housing has an end cap rotatably secured thereto to close the housing. The housing is filled with oil or grease. First and second springs, preferably coiled springs, are connected to the interior of the two end caps and to opposite ends of a weight suspended in the space of the housing. An indexer is provided on the rotatable end cap to indicate its rotated position and to releasably hold it in that position. As the end cap is rotated it increases or decreases, depending on its direction of rotation and the extent of its rotation, the tension on the springs, thus controlling their degree of resistance to displacement of the weight during shock absorption. Therefore, the degree of shock absorption is easily controlled by such rotation for fine tuning the weapon.

8 Claims, 1 Drawing Sheet

RECOIL ABSORBING STABILIZER FOR A WEAPON

BACKGROUND OF THE INVENTION

1. Field of the Invention

The present invention generally relates to stabilizers and more particularly to an improved hydraulic-type stabilizer for a weapon.

2. Prior Art

Various types of stabilizers have beer used on guns and archery bows, both longbows and crossbows. Most of such stabilizers merely comprise weights which are added to the frame of the weapon and may project outwardly therefrom in a preselected direction. Such stabilizers are used to dampen recoil when the shot is fired by increasing the effective weight of the weapon, thus permitting the use of more highly powered weapons without discomfort to the shooter. Archery longbows have used single or multiple stabilizers having rubber gaskets connecting long weight rods to the bow frame. Handguns and the like generally use short projecting weights.

Difficulties are encountered when stabilizers for guns and archery bows are used. In the case of archery longbows, it is critical that proper clearance be afforded for an arrow being shot from the bow so that the arrow point, shaft and rear vanes do not strike the bow and cause the arrow to fly off line and miss the target. Moreover, arrow flight is also affected at the moment of release of the arrow from the bow by the manner of interaction between the archer's torque on the string and the extent and direction of bow recoil.

Fine tuning of the bow is required for optimal shooting results. In the past this has meant, when stabilizers are used, the substitution of one stabilizer for another until the desired results are obtained. Alternatively, the stabilizer has had to be removed from the bow so that one or more parts thereof such as rubber connectors of various stiffnesses could be substituted. This has represented much monetary expense for multiple parts, much bow down-time for repairs and reassembly of stabilizers, etc.

In the case of guns, a similar problem has arisen when stabilizers have been added to the guns. This is particularly the case for automatic or semi-automatic handguns. Excessive recoil shock absorption in such guns results in unused cartridges not being fed properly into the firing chamber and used cartridges not being ejected properly. So-called "stove-piping" frequently occurs. This is a situation where the used cartridge casing is trapped by the recoiling gun slide before it can fully exit the gun. Firing of the next unused cartrdige cannot then occur. Instead, the shooter must pull out the hot used cartridge casing before firing can recommence. If a stabilizer is being used and is the cause, of the difficulty, it must be removed from the gun and another stabilizer must be substituted or the stabilizer must be left off of the gun.

In view of the foregoing difficulties, it would be highly desireable to be able to provide an improved stabilizer which could be easily and rapidly adjusted while on the weapon to change its shock absorbing characteristics in a controlled way, without substituting components. Such stabilizer should be utilizable for both archery bows and guns and should be simple, durable, inexpensive and highly efficient, with a capability of being accurately and reproducably set for maximum effect.

SUMMARY OF THE INVENTION

The improved stabilizer of the present invention satisfies all the foregoing needs. Thus, the stabilizer is simple, inexpensive, easy to adjust while on the weapon, can easily control the shock absorbability of the stabilzer over a wide range, and is durable. It does not require the substitution of parts is equally efficient on both archery bows and guns. It can be made in a wide range of sizes and shapes to suit individual needs.

The improved stabilizer is substantially as set forth in the ABSTRACT OF THE DISCLOSURE. Thus, it is of the hydraulic type. It comprises an elongated housing, preferably cylindrical, although it could be other shapes. The housing can be made of metal, plastic, etc. and has an annular sidewall which defines the housing in the form of a tubular configuration with open opposite ends and a central space extending the length of the housing and in communication with the open opposite ends.

One opposite end is closed by an end cap or plug bearing a connector for releasable attachment of the housing to the frame of an archery bow or gun. The opposite housing end is closed by a rotatable cap. Preferably, the space in the housing is filled with a viscous shock-absorbing material such as oil or grease.

To the end caps are connected first and second springs, preferably coiled, with one spring per cap. Each spring extends into the housing space and the two springs are connected to opposite ends of a weight or piston in the space and aligned for longitudinal movement in the space to absorb recoil shock.

When the rotatable end cap is rotated, the tension on the two springs is either decreased or increased, depending on the direction of rotation of that cap. The cap bears indexing means which releasably hold the cap in any desired rotated position and which indicate the location of that position. In one embodiment, the indexing means comprises a spring connected to the rotatable end cap and releasably moveable into and out of a spaced series of notches or openings disposed in a ring at the adjacent end of the sidwall. A mark on the end cap enables the user to determine the rotated position of the end cap.

Accordingly, while the stabilizer is in place on the weapon the weapon can be shot and then the stabilizer end cap can be rotated to increase or decrease, as needed, the shock-absorbing effect of the stabilizer in order to fine tune the weapon.

Various other aspects of the improved stabilizer of the present invention are set forth in the following detailed description and accompanying drawings.

DRAWINGS

DETAILED DESCRIPTION

Figure 1:
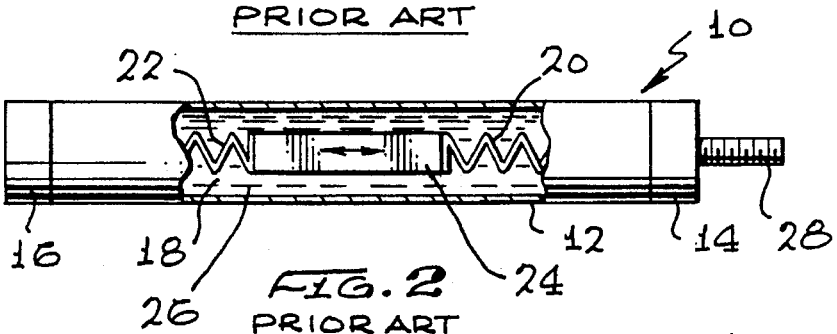
FIG. 1 PRIOR ART
FIG. 1 is a schematic side elevation, partly broken away, of one embodiment of a stabilizer of the prior art.
Figure 2:
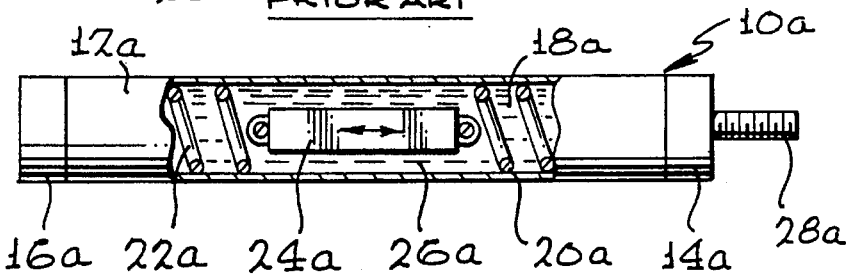
FIG. 2 PRIOR ART
FIG. 2 is a schematic side elevation, partly broken away, of a second embodiment of a stabilizer of the prior art.

Prior Art of FIGS. 1 and 2

Now referring more particularly to FIGS. 1 and 2 of the drawings, two versions of conventional hydraulic-type weapon stabilizers are displayed therein schematically. In FIG. 1, a stabilizer 10 is shown which comprises an open ended cylindrical tube 12 having end caps 14 and 16 permanently and immoveably fixed thereto to seal off tube 12. Tube 12 defines with end caps 14 and 16 a central space 18 extending the length of tube 12, in which space 18 are disposed two leaf springs 20 and 22 connected at one end thereof to, respectively, end caps 14 and 16. The opposite ends of springs 20 and 22 are connected, to a piston or weight 24 centrally positioned in space 18, the remainder of which is filled with hydraulic oil 26. A screw connector 28 is attached to the exterior of end cap 14 for releasable attachment of stabilizer 10 to a weapon frame (not shown).

Recoil in the weapon upon firing is dampened by the movement of weight 24 against springs 20 and 22 and through the body of oil 26. However, there is no means for adjusting the recoil absorbing ability of stabilizer 10.

Stabilizer 10*a* is substantially identical to stabilizer 10 and the components thereof bear the same numerals but are succeeded by the letter "a". The only difference between stabilizers 10 and 10*a* is that stabilizer 10*a* utilizes a pair of coiled springs 20*a* and 22*a* instead of leaf springs 20 and 22. The effect is the same as for stabilizer 10. Stabilizer 10*a* is also non-adjustable for recoil absorbtability.

FIGS. 3–6

A preferred embodiment of the improved weapon stabilizer of the present invention is schematically depicted in FIGS. 3–6. Thus, stabilizer 30 is shown which comprises an elongated tubular housing 32 formed of an annular sidewall 34 defining a central space 36 extending the length of housing 32 to open opposite ends 38 and 40. A first end cap 42 is permanently or releasably connected to sidewall 34 at end 38 thereof to close off end 38. A second end cap 44 is rotatably secured to opposite end 40 to close it off.

End cap 42 is fitted with a connector 46 comprising a longitudinally extending threaded bolt or screw 48 adapted to releasably secure stabilizer 30 to the frame of a gun or archery bow (not shown). End cap 44 includes indexing means 50 to releasably hold end cap 44 in any desired rotated position against end 40 and also to indicate the exact location of that rotated position.

Figure 3:
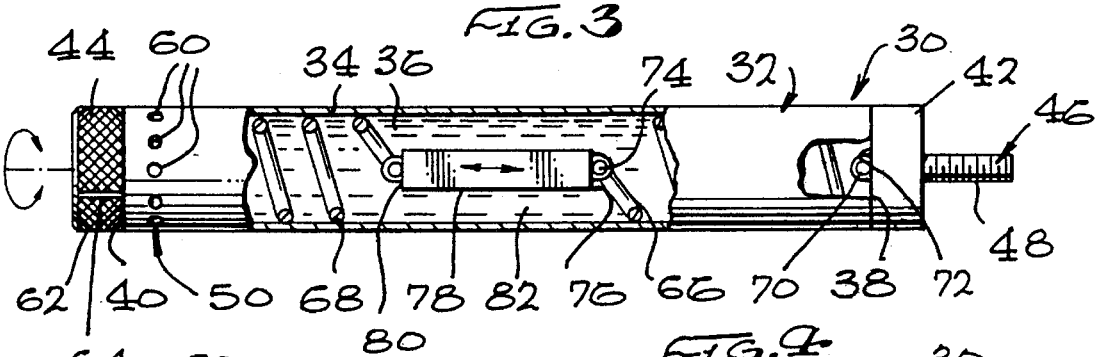
FIG. 3 is a schematic side elevation, partly broken away, of a preferred embodiment of the improved stabilizer of the present invention.
Figure 4:
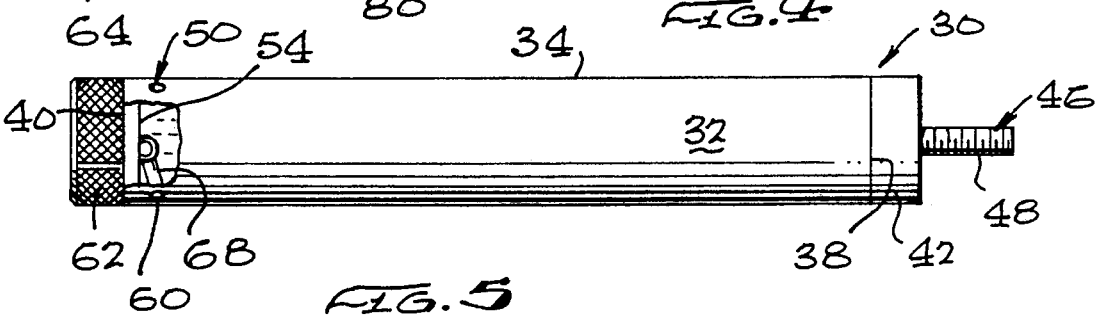
FIG. 4 is a schematic side elevation, partly broken away, of the stabilizer of FIG. 3, showing the connection of a spring detent with the rotatable end cap and also showing a housing notch, the spring detent and notch comprising indexing means.
Figure 5:
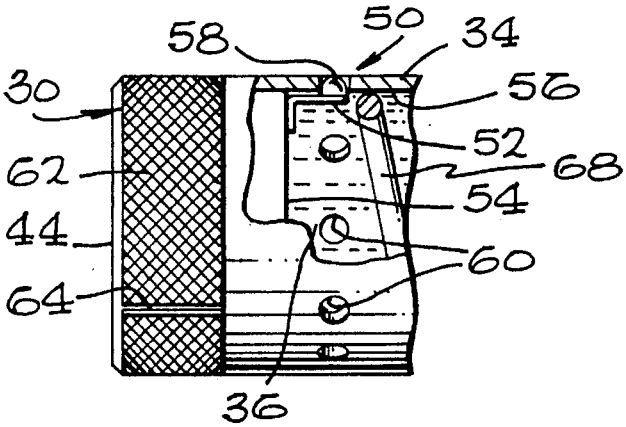
FIG. 5 is an enlarged schematic fragmentary side elevation showing the detent and housing notches of the stabilizer of FIG. 4; and, FIG. 6 is a schematic end view of the stabilizer of FIG. 3.
Figure 6:
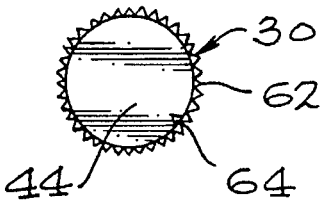

For such purposes, any suitable arrangement of components can be used. Indexing means 50 as illustrated in FIGS. 3–5 comprises an elongated spring detent 52 connected to the inner surface 54 of end cap 44 and having spring biased contact with the adjacent inner surface 56 of sidewall 34. The free end 58 of detent 52 is generally spherical and adapted to releasably seat in recesses 60 spaced in a ring along said adjacent inner surface 56. This arrangement provides end cap 44 with a click-stop capability. The exterior surface 62 of end cap 44 preferably is knurled and includes a longitudinally extending groove 64 or the like to indicate the exact rotated position of end cap 44.

Stabilizer 30 also includes first and second coiled springs 66 and 68 extending longitudinally in space 36. Spring 66 is fixedly connected at end 70 thereof to the inner surface 72 of end cap 42 while the opposite end 74 of spring 66 is fixedly connected to end 76 of a piston or weight 78 preferably elongated in shape and preferably disposed about mid-way along the length of space 36. Spring 68 is fixedly connected at one end thereof to inner surface 54 of end cap 44 out of contact with detent 52, while the opposite end of spring 68 is fixedly connected to end 80 of weight 78, as shown in FIG. 3.

Thus, springs 66 and 68 suspend weight 78 in space 36 for longitudinal movement therein in response to recoil force encountered by stabilizer 30 when the weapon to which it is attached is shot. Preferably, space 36 is filled with a body 82 of hydraulic oil or grease, most preferably the latter. Such body 82 resists to some extent the movement of weight 78 therethrough during recoil upon shooting of the weapon.

It will be noted that coiled springs 66 and 68 are coiled in the same direction, so that rotation of end cap 44 in one direction winds up springs 66 and 68, increasing their resistance to recoil movement of weight 78, while rotation of end cap 44 in the opposite direction unwinds springs 66 and 68, decreasing their resistance to recoil movement of weight 78.

Such winding and unwinding is precisely and reproducibly controllable, enabling stabilizer 30 to be easily and simply adjusted, without substitution of parts and while attached to the weapon, to control the extent of recoil absorption by stabilizer 30, for precise control of the characteristics of the weapon during recoil. This enables the gunner or archer to fine tune his or her weapon simply and effectively for optimal shooting characteristics and efficiency.

It will be understood that stabilizer 30 can be fabricated of any suitable materials and in any suitable size and shape. Preferably, tube 12 and end caps 42 and 44 are cylindrical. The decribed indexing means 50 can, if desired, be attached to the exterior of end cap 44 and sidewall 34 so that groove 64 or its equivalent can be dispensed with, detent spring 52 then serving as the visual indicator of the degree of rotation of end cap 44. Other modifications, changes, alterations and additions are also possible. All such modifications, changes, alterations and additions as are within the scope of the appended claims form part of the present invention.

PRIOR ART STATEMENT

A search of the prior art has not been made. The closest known prior art is that illustrated in FIGS. 1 and 2 of the drawings and discussed in the specification. Other stabilizers such as rubber cushioned elongated weights have been used on archery bows and the like but are not relevant to the present invention.

The present claimed invention is the first known to Applicant which incorporates means for easily adjusting the shock absorbability of the stabilizer without substituting components and while the stabilizer is in place on the archery bow, gun or other weapon needing shock absorption. This adjustability allows the user to fine tune the archery bow or gun for maximum effectiveness.

In the case of an automatic handgun, this tunability is needed in order to reduce recoil as much as possible for improved shooting accuracy, but without impairing the ability of the gun to feed unused cartridges and efficiently eject used cartridges. In the case of archery bows, this tunability is needed to maximize arrow clearance while providing minimum recoil, to improve arrow flight and shooting accuracy.

It is believed that the present stabilizer which accomplishes all the foregoing aims is clearly patentable.

What is claimed is:

1. An improved recoil absorbing stabilizer for a weapon, said stabilizer comprising, in combination:

a) an elongated generally tubular housing having first and second open opposite ends and an annular sidewall defining therewith a central space extending the length of said housing and communicating with said opposite ends;

b) a first end cap fixedly secured to said first end of said housing to close said first opposite end;

c) means connected to said first end cap for releasably connecting said housing to the exterior of a weapon in operative recoil-absorbing position;

d) a second end cap rotatably secured to said second opposite end to close said second opposite end;

e) a first spring connected to the interior of said first end cap and extending into said space;

f) a second spring connected to the interior of said second end cap and extending into said space;

g) a weight positioned in said space for longitudinal movement therein, said weight having two opposite ends, one of which weight ends is connected to said first spring and the other of which two weight ends is connected to said second spring; and, h) indexing means connected to said second end cap and to said housing to selectively hold said second end cap in a selected rotated position, whereby selective winding and unwinding of said two springs by rotation of said second end cap varies the tension on said two springs and their resistance to longitudinal displacement of said weight for tunable recoil absorption by said stabilizer.

2. The improved stabilizer of claim 1 wherein said indexing means comprises a spring detent connected to the interior surface of said second end cap and extending inwardly therefrom in said space and contacting the adjacent interior surface of said sidewall and wherein said sidewall adjacent surface includes a plurality of spaced detent receptors disposed around said sidewall for click-stop indexing.

3. The improved stabilizer of claim 2 wherein said indexing means includes at least one mark disposed longitudinally of said housing on the exterior of said second end cap to mark the rotated position of said second end cap.

4. The improved stabilizer of claim 2 wherein said detent recptors comprise openings in said adjacent sidewall.

5. The improved stabilizer of claim 1 wherein said housing is generally cylindrical and wherein said springs are coiled springs wound in the same direction.

6. The improved stabilizer of claim 1 wherein said space is filled with a viscous, weight-movement resisting, shock absorbing material.

7. The improved stabilizer of claim 6 wherein said viscous material comprises one of grease and oil.

8. The improved stabilizer of claim 1 wherein the exterior of said second end cap is knurled to facilitate rotation thereof and wherein said weight is elongated and positioned longitudinally in said space.

* * * * *